United States Patent [19]

Barkus et al.

[11] Patent Number: 4,966,557

[45] Date of Patent: Oct. 30, 1990

[54] ELECTRICAL CONTACT ELEMENT

[75] Inventors: Lee A. Barkus, Millersburg; Steven J. Kandybowski, Tower City; David B. Sinisi, Harrisburg, all of Pa.

[73] Assignee: AMP Incorporated, Harrisburg, Pa.

[21] Appl. No.: 278,119

[22] Filed: Nov. 30, 1988

Related U.S. Application Data

[63] Continuation-in-part of Ser. No. 129,035, Dec. 4, 1987, abandoned.

[51] Int. Cl.[5] ..... H01R 13/428

[52] U.S. Cl. ..... 439/246; 439/751

[58] Field of Search ..... 439/733, 751, 869, 871–873, 439/246, 252

[56] References Cited

U.S. PATENT DOCUMENTS

| | | | |
|---|---|---|---|
| 3,144,577 | 8/1964 | Tyson et al. | 439/869 |
| 3,444,504 | 5/1969 | Lynch et al. | 439/733 |
| 3,486,163 | 12/1969 | DeVuyst et al. | 439/733 |
| 4,286,837 | 9/1981 | Yasutake et al. | 439/733 |
| 4,317,609 | 3/1982 | Lapraik | 439/873 |
| 4,859,198 | 8/1989 | Owen | 439/252 |

FOREIGN PATENT DOCUMENTS

| | | | |
|---|---|---|---|
| 1810513 | 6/1970 | Fed. Rep. of Germany | 439/733 |
| 0032308 | 11/1968 | German Democratic Rep. | 439/751 |

OTHER PUBLICATIONS

IBM Technical Disclosure Bulletin, "Connector Block Hole Formation", by E. C. Uberbacher, vol. 3, No. 6, Nov. 1960.

*Primary Examiner*—Gary F. Paumen

*Attorney, Agent, or Firm*—Allan B. Osborne

[57] ABSTRACT

An improved electrical contact element for use in connector housings. More particularly, the contact element includes a U-shaped retention section having one resilient leg extending obliquely outwardly. Further included is a resilient web in between and connecting the forward termination section and retention section to provide a degree of independent movement of the former relative to the latter.

5 Claims, 4 Drawing Sheets

ELECTRICAL CONTACT ELEMENT

This application is a continuation-in-part of Ser. No. 129,035, filed Dec. 4, 1987, now abandoned.

FIELD OF THE INVENTION

The present invention relates to contact elements for use in electrical connectors and more particularly to the retention and alignment of such elements in cavities in connector housing.

BACKGROUND OF THE INVENTION

Contemporary electrical contact elements of the type positioned in cavities in connector housings are generally retained therein by a frictional fit which, where the cavities meet manufacturing specifications, have a predictable retention value. However, the cavity dimensions normally do not meet the exact specifications even though they are within given tolerances. Thus, the frictional fit cannot be predicted with certainty. Further, the forward termination section and retention section are immediately adjacent to each other so that misalignment of the retention section caused a misalignment of the termination section with respect to cavity openings and preload barriers if present. As is well known, a skewed termination section can result in poor electrical mating.

Accordingly, it is now proposed to provide an improved electrical contact element having a U-shaped retention section with one resilient leg to permit conformable positioning in a cavity with predictable retention values and further having a resilient web between and connecting the forward termination section and retention section to permit a degree of independent movement of the former with respect to the latter.

SUMMARY OF THE INVENTION

According to the invention, an improved electrical contact element is provided wherein the retention section is U-shaped with one leg being resilient and extending obliquely outwardly from its attachment to the bight.

Further, a resilient web is between and connects the forward termination section and retention section to permit independent movement of the former with respect to the latter.

DESCRIPTION OF THE INVENTION

Figures 1, 2, 3:
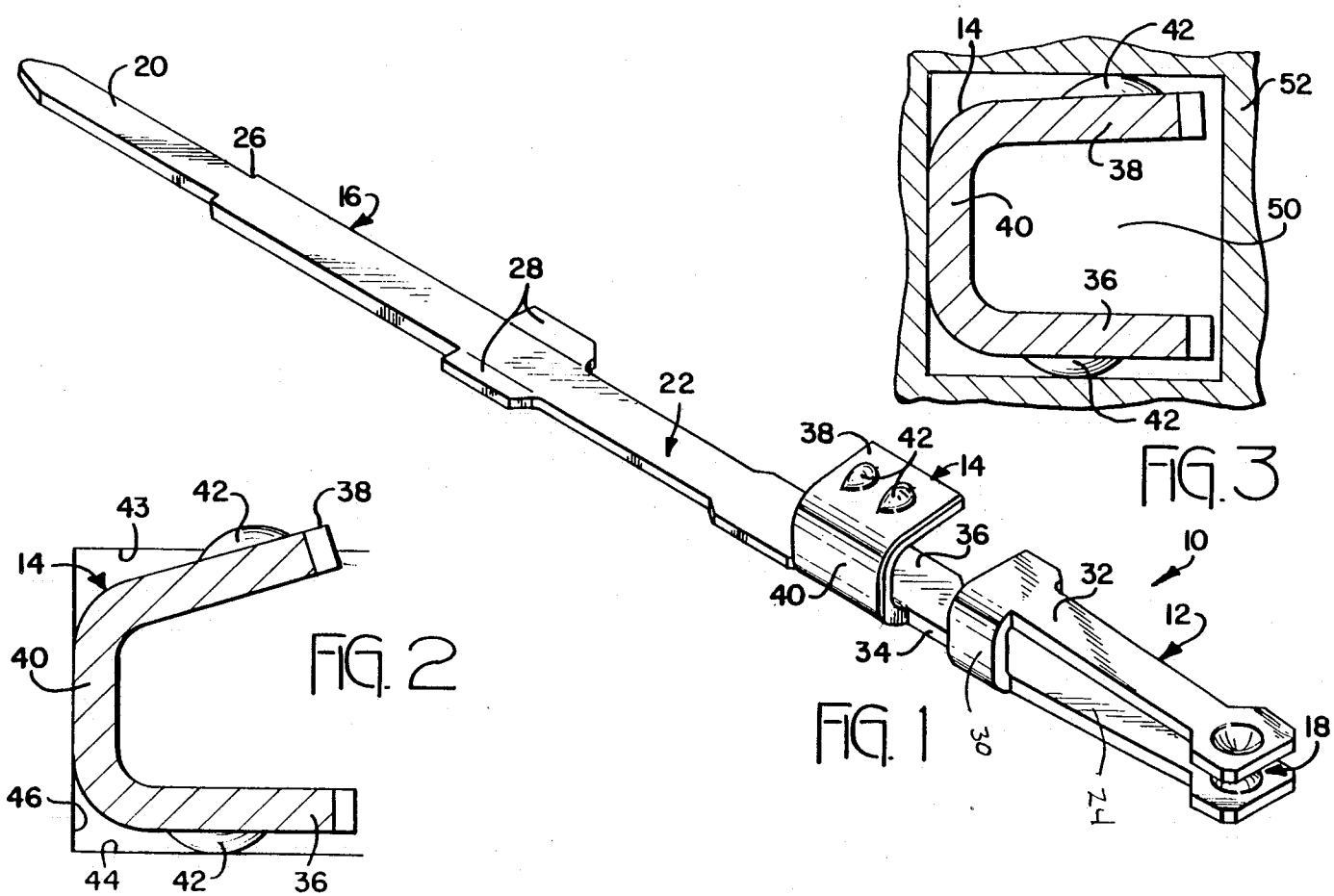
FIG. 1 is a perspective view of the contact element constructed in accordance with the present invention.
FIG. 2 is a cross-sectional view of the retention section of the contact element prior to being positioned in a housing cavity.
FIG. 3 is a cross-sectional view of the retention section after being positioned in a housing cavity.

Contact element 10 shown in FIG. 1 is preferably stamped and formed from copper alloy or other suitable conductive material. Element 10 includes a forward termination section 12, retention section 14 and rearward termination section 16. Shown for illustrational purposes only; i.e., other termination sections can be used if desired, forward termination section 12 is a two beam receptacle or socket 18 which receives a post (not shown) and rearward termination section 16 is a rectangular lead 20 of the type which may be inserted and soldered into a plated through hole in a printed circuit board (not shown).

Base member 22 of contact element 10 extends the length thereof, forming one beam 24 of socket 18 at one end and lead 20 at the other end. Structural features along member 22 may include shoulders 26 for abutting the surface of a circuit board and laterally extending positioning ears 28.

Socket 18 is formed by bending strap 30, which is attached to base member 22 and to the other beam 32, so that the two beams 24,32 overlie each other.

Base member 22 also provides web 34 which is between forward termination section 12 and retention section 14.

Retention section 14 is U-shaped with leg 36 being coincidental with base member 22. The second leg 38 is formed to extend obliquely outwardly from bight 40 which is between and attached to the two legs 36,38. FIG. 2 shows more clearly the spatial relation of legs 36,38. Lances 42 are provided on the outwardly facing surfaces of each leg 36,38.

Retention section 14 is shown in FIG. 2 against an outline representing cavity walls 44,46,48 to illustrate clearly the spatial arrangement of legs 36,38 prior to contact element 10 being inserted into a cavity. As noted above, leg 38 extends obliquely outwardly from its attachment to bight 40. The divergence is predetermined so that the space between legs 36,38 is greater than the space between opposing walls 44,48.

FIG. 3 is a view of retention section 14 positioned in cavity 50 of connector housing 52. As can be seen, leg 38 has been resiliently urged inwardly toward leg 36 to conform to the cavity space. The compliancy of retention section 14 lowers its sensitivity to cavity size and accordingly makes its retention within the cavity more predictable as opposed to retention sections which are based on a strict interference fit; e.g., the interference fit of a retention section in a cavity being at the high end of the manufacturing tolerance range would be low while the fit could be very tight in a cavity at the low end of the tolerance range.

Figure 4:
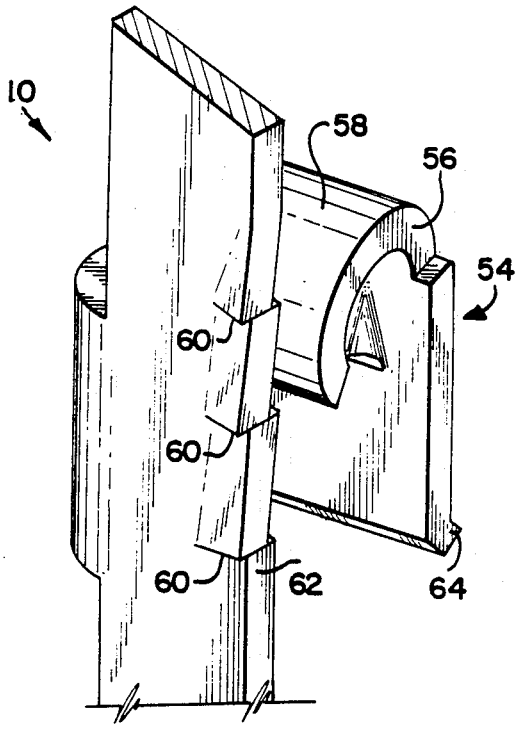
FIG. 4 is a perspective view showing another embodiment of the retention section.

FIG. 4 shows another embodiment of a compliant retention section. That section, indicated by reference numeral 54, includes an arcuate-shaped leading edge 56 attached to leg 38 and curved in towards opposite leg 36. Convex surface 58 thereon prevents stubbing during insertion of element 10 into cavity 50.

Further, the embodiment shown in FIG. 4 includes teeth 60 provided along the free edge 62 of leg 36 in lieu of a lance 42. As can be seen, teeth 60 are formed by slitting and offsetting edge 62. Also, the trailing edge 64 of leg 38 has been turned outwardly to provide additional resistance to element withdrawal from cavity 50.

Figure 5:
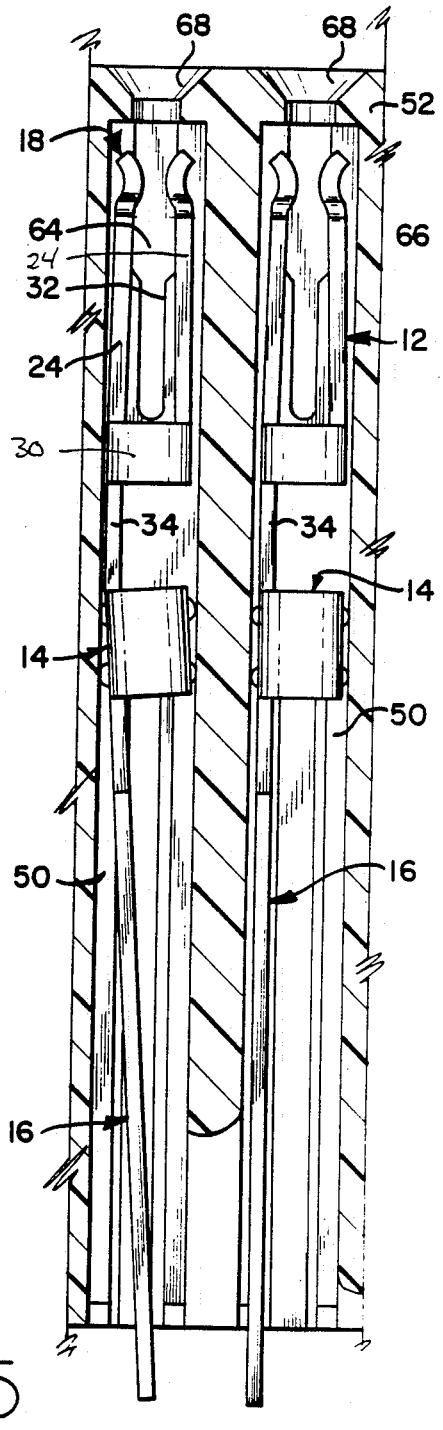
FIG. 5 is a side view, partly sectioned, showing how the flexible web between the forward termination section and retention section permits proper alignment of the former in a cavity of a connector housing.

FIG. 5 illustrates the advantage of having forward termination section 12 spaced from and connected to retention section 14 by resilient web 34. As shown in cavity 50 to the right, contact element 10 has been inserted straight in so that beams 24,32 of socket 18 are symmetrically positioned on preload rib 66 and also with respect to cavity entrance 68. Contact element 10 in cavity 50 to the left however, has been inserted at an angle as reflected by the tilted position of retention section 14 and rearward termination section 16. However, socket 18 of the forward termination section 12, because of resilient web 34, was able to float into proper alignment with respect to rib 66 and entrance 68.

Figure 6:
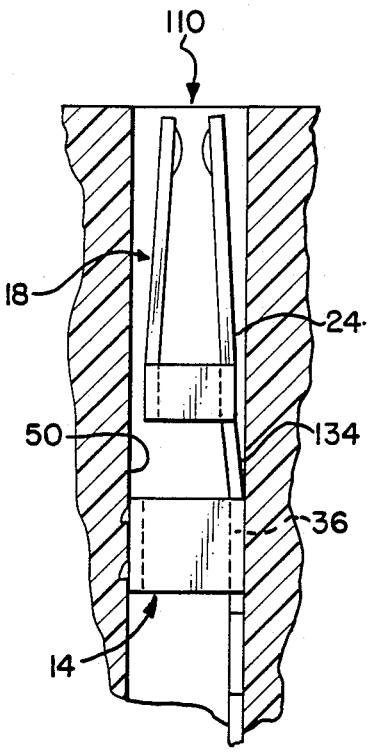
FIGS. 6 and 7 are plane views of other embodiments of the present invention.
Figure 7:
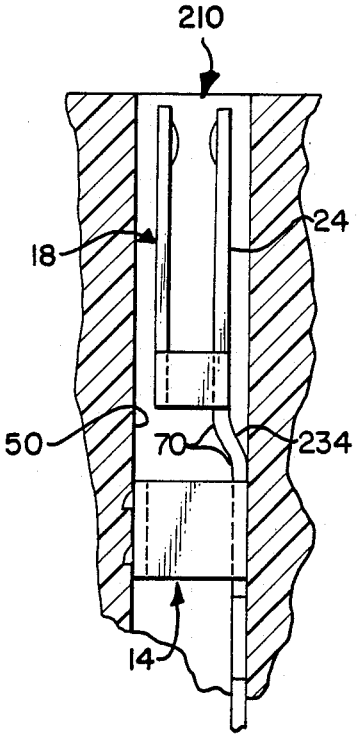

FIGS. 6 and 7 illustrate other embodiments of the present invention. Contact element 110 shown in FIG. 6 is identical to contact element 10 except for web 134 which has been bent adjacent beam 24 and leg 36 so that socket 18 is centered with respect to retention section 14. With respect to contact element 210 shown in FIG. 7, web 234 thereon has also been bent to center socket 18 but at locations removed from beam 24 and leg 36.

As with web 34, webs 134 and 234 provide a degree of resiliency to socket 18 without reducing the normal forces beams 24,36 exerted against a male pin 76 (FIGS. 8 and 9) inserted therebetween.

Figure 8A:
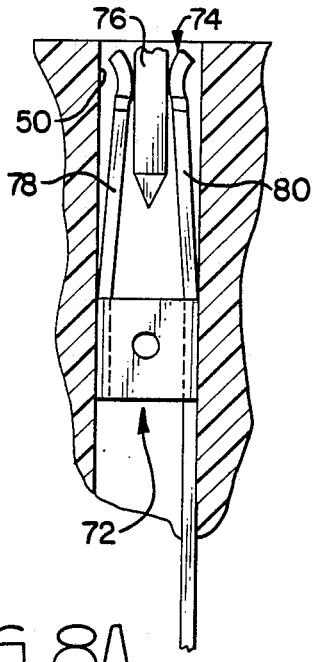
FIG. 8A PRIOR ART
FIGS. 8A and 8B are plane views of a prior art contact element illustrating beam displacement caused by an off-centered insertion of a male pin.
Figure 8B:
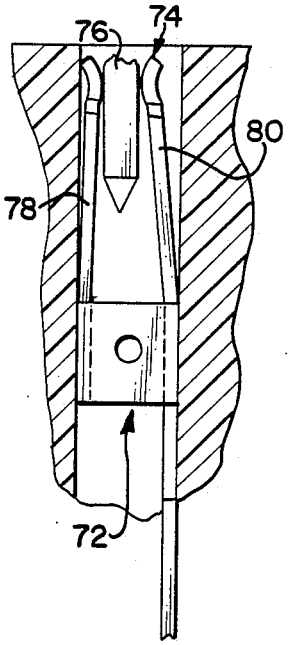
FIG. 8B PRIOR ART
Figure 9:
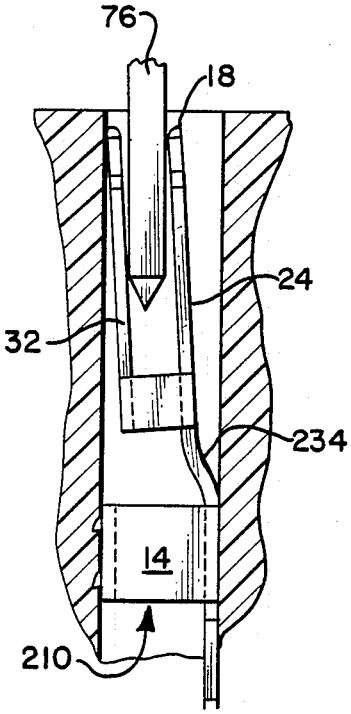
FIG. 9 is a plane view of one embodiment of the present invention illustrating beam displacement caused by an off-centered insertion of a male pin.

FIGS. 8 and 9 illustrate the aforementioned advantage.

FIG. 8A shows a prior art contact element 72 with socket 74 centered in cavity 50 and with male pin 76 squarely inserted therein. Because beams 78,80 have been spread apart equally, the normal forces exerted against pin 76 by the beams are equal. Contra, pin 76 has been inserted into socket 74 off-center and accordingly the normal force exerted against pin 76 by beam 78 is substantially greater than the force exerted by beam 80.

The same situation shown in FIG. 8B is shown in FIG. 9 with respect to contact element 210. Although pin 76 has been inserted off-centered, socket 18 as a unit shifts to be more in line with pin 76 because of the resiliency of web 234. Accordingly, although beam 32 will exert a greater normal force against pin 76 than beam 24, the different is not substantial.

The aforementioned differences between prior art contact element 72 and contact elements 10,110 and 210 is a function of resilient webs 34,134 and 234. With respect to contact element 72, beams 78,80 are short and thus relatively stiff to provide the required normal forces. While beam 24,32 are not any longer than beams 78,80, the additional length of resilient web 34,134,234 makes beams 24,32 act as beams would having the combined length but without sacrificing normal force capability.

As can be discerned, an improved electrical contact element for use in connector housings has been disclosed. The contact element includes a resilient U-shaped retention section which conforms to cavity dimensions upon insertion thereinto and accordingly provides more predictable retention values. Further, the contact element includes a resilient web extending between the forward termination section and retention section. Thus, the forward termination section is permitted to float and center itself in the event the contact element is inserted at a slant. Further, the resilient web adds length to the beams of the socket without reducing the capability thereof to exert normal force against a male pin inserted therebetween.

We claim:

1. An improved electrical contact element comprising:

an elongated base member;

a receptacle for receiving a male terminal therein directly attached to one end of said base member;

a rearward termination section attached to another end of said base member; and a U-shaped retention section intermediate said receptacle and said rearward termination section and spaced from said receptacle and having first and second leg means with bight means attached to and extending therebetween, said first leg means being a portion of said base member and said second leg means being resilient and extending obliquely outwardly from its attachment to said bight means.

2. The contact element of claim 1 wherein said base member between said receptacle and said retention section is resilient to permit a degree of independent movement of the former relative to the latter.

3. The contact element of claim 1 wherein the base member between said receptacle and said retention section positions the former on the same center line with the latter.

4. The contact element of claim 1 further including an arcuate-shaped leading edge means on said second leg means, said edge means curving inwardly towards said first leg means so that a convex surface thereon faces the receptacle.

5. An improved electrical contact element comprising an elongated base member with a receptacle for receiving a male terminal therein and a termination section attached to opposite ends of said base member, and a U-shaped retention section between and spaced from said receptacle and said termination section, said retention section having first and second legs with a bight attached to and extending therebetween, said first leg being a portion of said base member and said second leg being resilient and extending obliquely outwardly from its attachment to said bight.

* * * * *